United States Patent [19]

Levén

[11] Patent Number: 5,036,907

[45] Date of Patent: Aug. 6, 1991

[54] CROSSFLOW RECUPERATIVE HEAT EXCHANGER

[75] Inventor: Witek Levén, Levenegatan, Sweden

[73] Assignee: PM-LUFT, Kvanum, Sweden

[21] Appl. No.: 392,459

[22] Filed: Aug. 11, 1989

[30] Foreign Application Priority Data

Sep. 6, 1988 [SE] Sweden ..... 8803112

[51] Int. Cl.[5] ..... F28F 13/02; F28F 13/12; F28F 3/04

[52] U.S. Cl. ..... 165/54; 165/146; 165/166; 165/903; 165/909

[58] Field of Search ..... 165/54, 146, 147, 166, 165/903, 909

[56] References Cited

U.S. PATENT DOCUMENTS

| | | | |
|---|---|---|---|
| 4,049,051 | 9/1977 | Parker | 165/146 |
| 4,263,966 | 4/1981 | Östbo | 165/166 |
| 4,263,967 | 4/1981 | McNab et al. | 165/166 |
| 4,579,163 | 4/1986 | Maendel | 165/166 |
| 4,623,019 | 11/1986 | Wiard | 165/146 |
| 4,729,428 | 3/1988 | Yasutake et al. | 165/166 |
| 4,765,397 | 8/1988 | Chrysler et al. | 165/903 |

FOREIGN PATENT DOCUMENTS

| | | | |
|---|---|---|---|
| 2630905 | 12/1978 | Fed. Rep. of Germany | 165/166 |
| 0238684 | 11/1985 | Japan | 165/903 |
| 0238689 | 11/1985 | Japan | 165/903 |
| 0798469 | 7/1981 | U.S.S.R. | 165/903 |
| 1043471 | 9/1983 | U.S.S.R. | 165/166 |
| 1325285 | 7/1987 | U.S.S.R. | 165/166 |

*Primary Examiner*—John Ford

*Attorney, Agent, or Firm*—Dennison, Meserole, Pollack & Scheiner

[57] ABSTRACT

In flat heat exchangers for ventilating dwellings, swimming pools, public premises, etc., which are used for air entering and leaving, problems arise when the air entering has low temperature. This results in a cold corner (A) appearing in the heat exchanger and its efficiency thus being reduced. The object of the present invention is to reduce the effect of the cold corner by introducing throttling means (9) along a number of the channels (3) for air leaving. The throttling means (9) are of equal size along one and the same channel, but different in the different channels (3), the channel (3) with the smallest throttling means (9) being located closest to the inlet for the air.

19 Claims, 4 Drawing Sheets

FIG. 7A
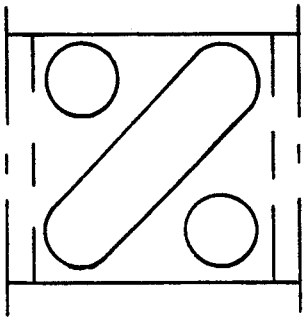
FIG. 7B
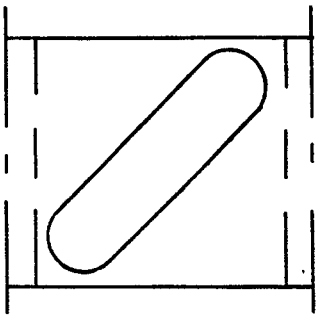
FIG. 7C
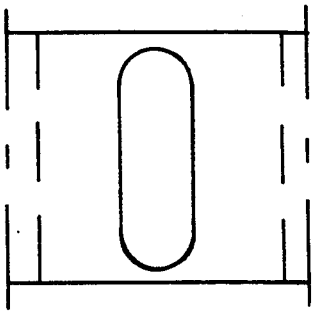
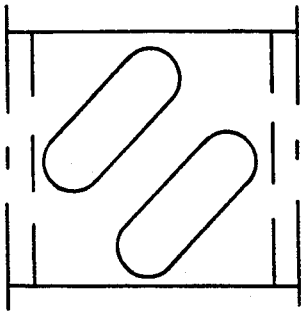
FIG. 7D
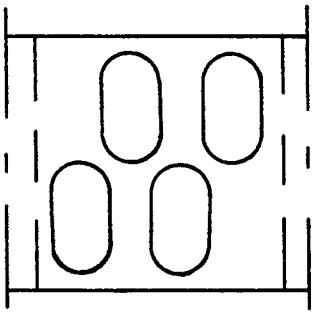
FIG. 7E
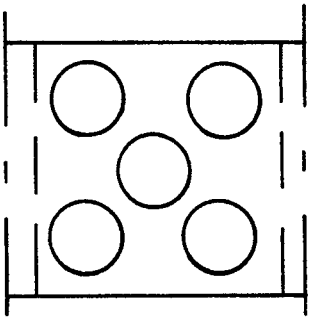
FIG. 7F

CROSSFLOW RECUPERATIVE HEAT EXCHANGER

BACKGROUND OF THE INVENTION

The present invention relates to a flat heat exchanger for two gaseous media crossing each other, where one medium transfers heat to the other medium, such as the air entering and leaving a dwelling.

Flat heat exchangers of the type mentioned are used primarily in heat-recovery units in ventilation systems. An example is shown in the accompanying FIG. 1. The flat heat exchanger consists of a large number of laminations with spaces between them. Air entering and air leaving flow through alternate spaces. It is generally the heat from an airflow leaving the premises (exhaust air) which is transferred to an airflow entering the premises (makeup air), the air flows passing through the heat exchanger in different channels. The laminations are often made of aluminium and the distance between them can be maintained in various ways. One example is by means of ridges in the laminations.

Like all other types of heat exchangers, flat heat exchangers have both advantages and disadvantages. One of the greatest disadvantages with flat heat exchangers is the considerable risk of them freezing when the temperature outside drops below 0° C. In recuperative heat exchangers the exhaust air is normally a warm, moist air and is cooled by a cold air flow consisting of fresh air or the like. These air flows exchange heat in the heat exchanger without coming into direct contact with each other. The cooling flow of fresh air or the like absorbs heat from the exhaust air, thus lowering its temperature. This causes precipitation or condensation of moisture on the heat-exchanging surfaces of the exhaust air channels in the system. When the outside temperature is low (below 0° C.), this results in frost and the formation of ice. Such ice formation reduces the coefficient of heat transfer of the heat exchanger, leading to poorer heat transfer and necessitating a reduction in the temperature efficiency of the exchanger by by-passing a portion of the makeup air, for instance. A number of methods can be used to prevent ice forming and the exhaust air channels freezing up. A pressure gauge may be used, for instance, to sense when the pressure drop from the outflow side has increased due to ice, and the air entering can then be allowed to flow through the by-pass damper. However, it may take a considerable time for the ice to melt. Another method is to continuously regulate the by-pass damper so that ice is never formed. This can be achieved with the aid of a temperature transducer located where the air leaves the cold edge of the heat exchanger. All methods of preventing the formation of ice prevent maximum efficiency of the heat exchanger during the winter period. This is particularly noticeable in cold climates. All methods of preventing ice formation and freezing entail an extra loss of valuable energy.

BRIEF DESCRIPTION OF THE DRAWINGS

FIGS. 7A–7F show various patterns of upraised heat transfer surfaces.

DETAILED DESCRIPTION

Figure 1:
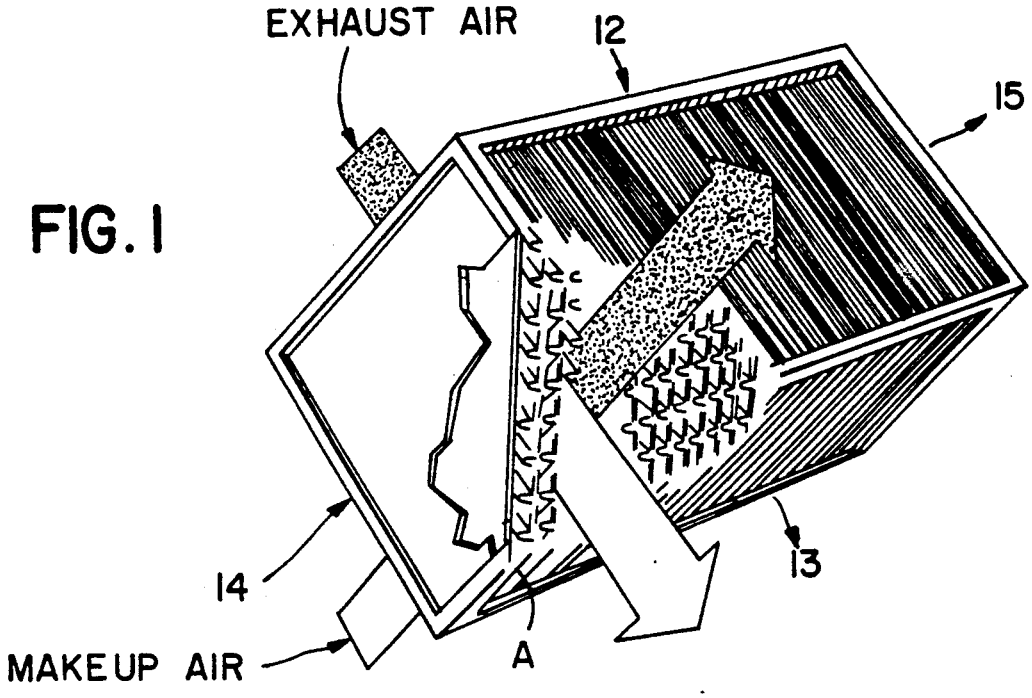
FIG. 1 is a perspective view of the crossflow heat exchanger of the present invention with a portion broken away to disclose the interior.

FIG. 1 shows a crossflow heat exchanger with exhaust air entering first intake face 12 and leaving through first discharge face 13. Makeup air enters second intake face 14 and leaves through second discharge face 15. The stippled ends of the flow arrows represent higher temperatures. Thus, warm exhaust air entering face 12 loses some of its heat to the incoming cooler makeup air which in turn is discharged at a higher temperature. As explained above, a problem exists when the makeup air falls below freezing temperatures. The cold makeup air can freeze moisture condensed out of the exhaust air forming a layer of frost on the interior surfaces of the exhaust air channels thereby reducing heat transfer efficiency. The frost buildup occurs around corner "A" in the figures and gradually creeps inwardly. This invention solves the problem of frost creep around corner "A" by raising the temperature at this location by controlling the rates of heat transfer as will be explained in detail below.

Figure 2:
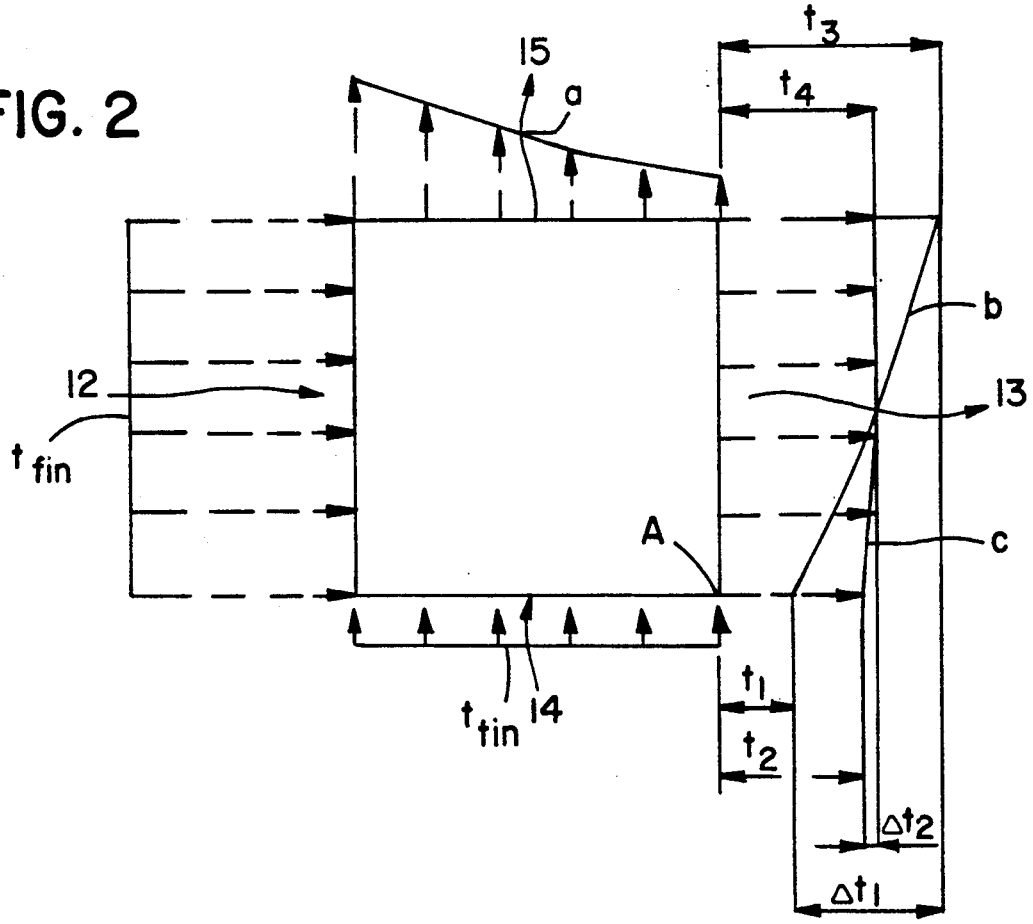
FIG. 2 is a temperature diagram for the inlet and outlet temperatures of the entering and leaving gaseous medium.

The temperature of the air leaving the flat heat exchanger varies from edge to edge. An example of this is shown in FIG. 2. Uneven air-temperature distribution at the outlet side causes one corner (marked "A" in FIG. 2) to have considerably lower temperature than the other corner on the outlet side. This corner will be termed the cold corner. The cold corner is particularly prone to freezing.

The designations in FIG. 2 have the following significance:

$t_{fin}$—inflow temperature of the exhaust air, $t_{tin}$—inflow temperature of the makeup air, $t_1$—temperature of the exhaust air leaving the heat exchanger in the coldest corner in a conventional heat exchanger, $t_2$—temperature of the exhaust air leaving the heat exchanger in the coldest corner in a new exchanger, $t_3$—temperature of the exhaust air leaving the heat exchanger in the warmest corner in a conventional heat exchanger, $t_4$—temperature of the exhaust air leaving the heat exchanger in the warmest corner in the new heat exchanger, a—distribution of makeup air temperature leaving the heat exchanger in a conventional heat exchanger, b—distribution of the exhaust air temperature leaving the heat exchanger in a conventional exchanger, c—distribution of the exhaust air temperature the heat exchanger in the new heat exchanger, $\Delta t_1$—difference between the coldest and warmest temperature of the exhaust air leaving after the heat exchanger in a conventional type, $\Delta t_2$—difference between the coldest and warmest temperature of the exhaust air leaving the heat exchanger in the new heat exchanger.

The temperature level of the exhaust and the makeup air affects and determines the temperature level of the laminations. When the temperature of the laminations separating the two air flows drops below 0° C., the condensation will be turned into ice in the cold corner of the heat exchanger. A more uniform temperature distribution of the exhaust air at the outlet of the exchanger produces a more uniform temperature distribution in the laminations at the outlet. A higher temperature in the air leaving in the cold corner, thus increases the temperature of the laminations in that corner.

The temperature in the coldest corner is the most significant and decisive with respect to reducing the temperature efficiency. The temperature in the coldest corner, thus affects the time during which the heat exchanger is used to 100% efficiency and this in turn is extremely important from the energy saving aspect.

The object of the present invention is to reduce the drawbacks of the cold corner discussed above. This is achieved according to the invention by allowing the makeup air entering the system, between its inlet face and its outlet face, to pass a number of channels for exhaust air leaving the system in which the heat-emitting capacity of said channels increases in transverse direction from the makeup air inlet face to the outlet face. The increase may be continuous or stepwise. The heat-emitting capacity of the channels for makeup air can be regulated in similar manner. The air in the various channels for makeup air may be subject to a changing heat transfer rate. The air flows may be laminar or turbulent. The heat-emitting capacity can also be increased by providing a channel with extra surfaces in the form of longitudinal, inwardly facing flanges, for instance, or depressions of various types. Arranging flanges of depressions which deviate from the longitudinal extension enables increased turbulence in the air flowing through.

The heat transfer in said flat heat exchanger can be increased if the channels for makeup air are designed so that each channel increases in its capacity to absorb heat along its direction of flow. This can be achieved by gradually increasing the extra surfaces in the form of depressions, which may be purely longitudinal or may have a direction deviating therefrom. Inwardly directed longitudinal flanges or flanges with deviating direction can of course be used instead of the depressions.

Two types of laminations are thus required to construct a heat-exchanger package, these laminations being placed one on top of the other so that crosswise through-flow is obtained.

Figure 3:
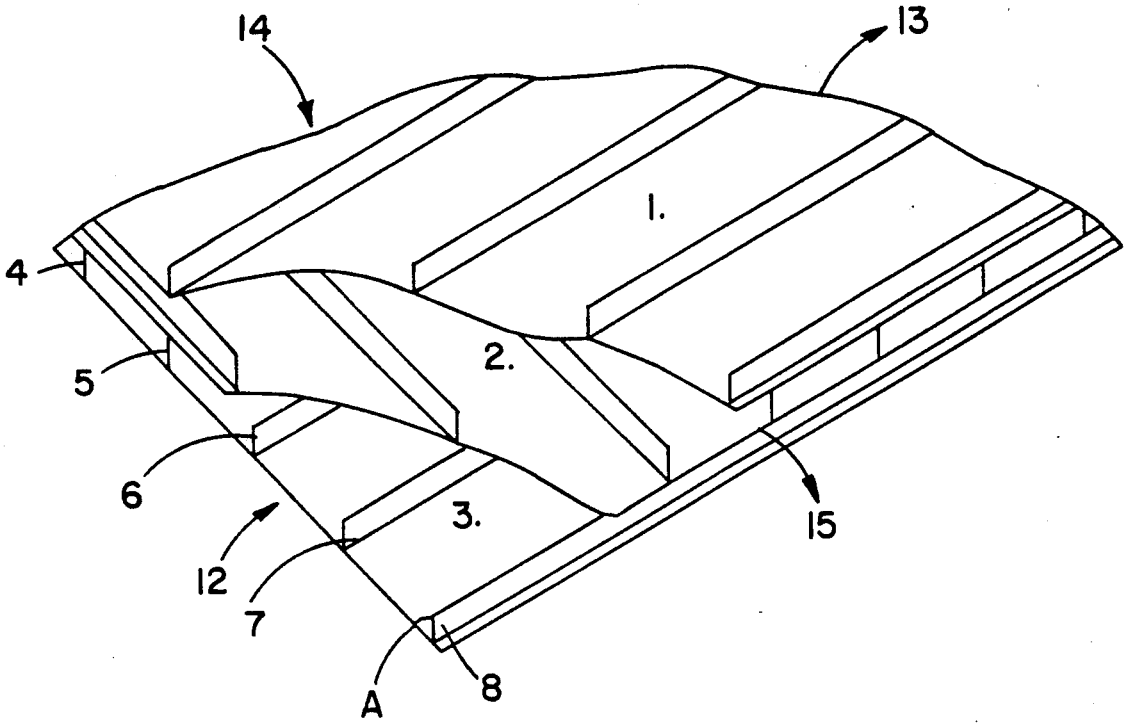
FIG. 3 is a perspective view with parts broken away of the stacked laminations and flanges forming the flow channels.
Figure 4:
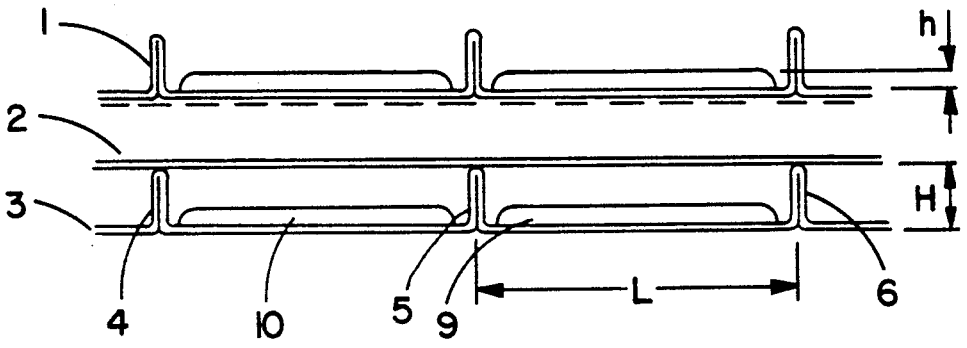
FIG. 4 is an end view of FIG. 3 showing the flow channels in greater detail.
Figure 5:
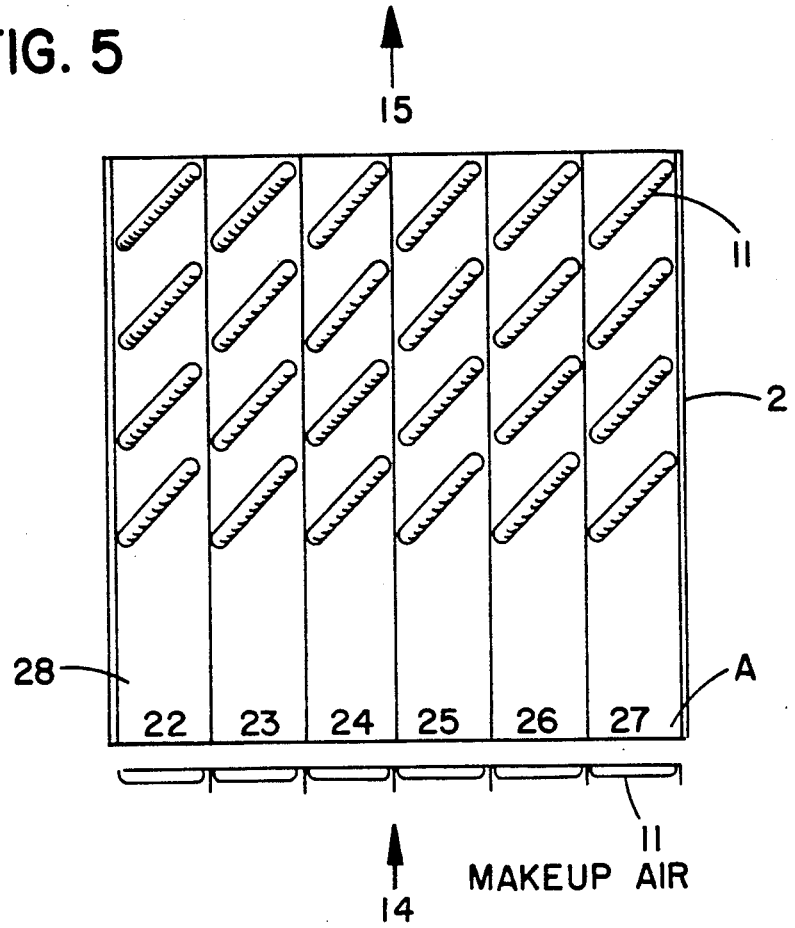
FIG. 5 is a top plan view of a makeup air lamination showing the flow channels with upraised heat transfer surfaces.
Figure 6:
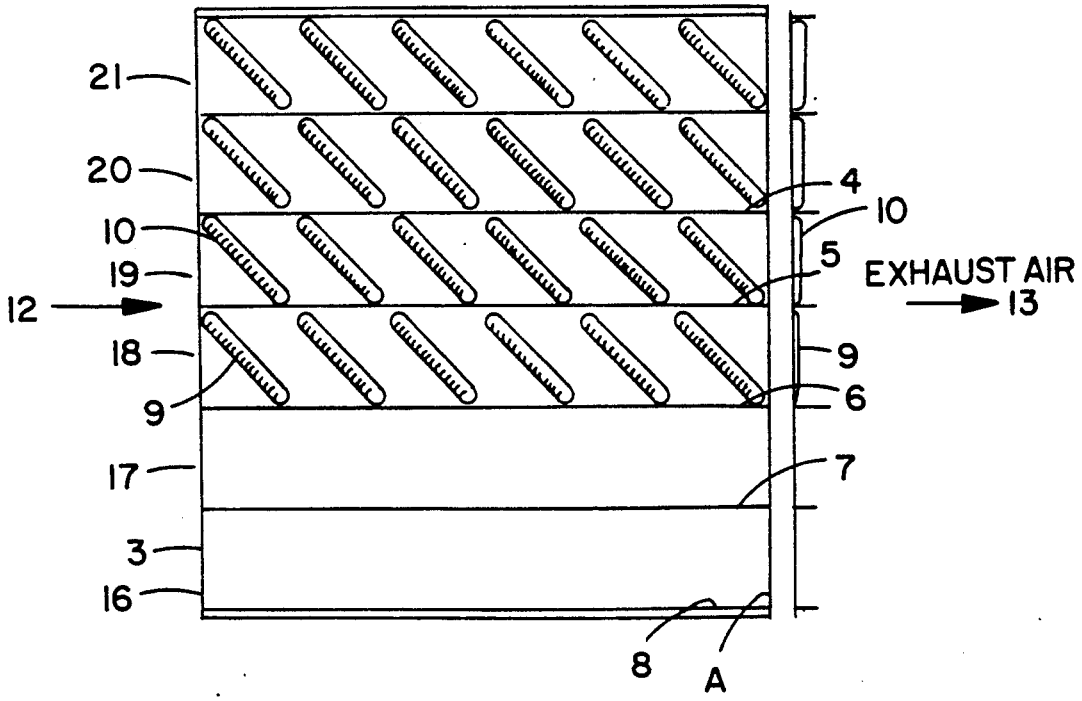
FIG. 6 is a top plan view of an exhaust air lamination showing the flow channels with upraised heat transfer surfaces.

FIG. 3 shows three laminations 1, 2 and 3 placed one on top of the other. Each lamination has a flat bottom which forms the bottom of the flow channel, and each lamination is provided with a number of parallel, upwardly directed flanges 4, 5, 6, 7 and 8. The bottom and flanges of each lamination may be produced by an extrusion process or they may be made of a single plate or foil, preferably of metal such as aluminium, which is bent as shown in FIG. 4. All the laminations in FIG. 3 have flat bottoms. The advantage of the type of lamination shown in FIG. 3 is that only one type of lamination is required to construct a flat heat exchanger, the laminations being stacked alternately turned at 90° to each other. Each lamination has a bottom and side walls forming its channels, the top of the channel being provided by the lamination above. Lamination 3 with flanges 4–8 form exhaust air channels 16–21 as shown in FIG. 6. Lamination 2 with upstanding flanges form makeup air channels 22–27 as shown in FIG. 5. Laminations as illustrated in FIG. 3 are excellent for constructing flat heat-exchanger packages avoiding the problems caused by a cold corner.

FIGS. 4, 5 and 6 show laminations provided with throttling means, said means being designated 9 and 10 in FIGS. 4 and 6, but in FIG. 5 they are designated 11. The throttling means in these three figures are produced by punching depressions on the back of the channel bottoms, thus producing elevations in the channels to throttle the flow.

The elevations may be any shape provided they effect throttling. FIG. 7 shows several different types of elevation.

In FIG. 4 it is seen that an elevation may have a height h and a flange a height H. The height H may have a value of 2–10 mm and a channel may have a width L of 30–100 mm. A favourable width is 33–39 mm. The height of a punching h may have a value of 0.1–3 mm.

FIG. 5 shows a lamination 2 for makeup air entering, with elevations 11. Each channel is provided with a number of elevations arranged along the length of the channel. In each channel the elevation furthest to the actual inlet opening for the air entering is highest. The height of the elevations then decreases gradually towards the inlet opening where a zone 28 is provided with no elevations. Looking now at the lamination 3 for air leaving the premises, not all the channels are provided with elevations 9. The elevations in each channel are the same height, but the elevations in the four different channels 18–21 are different, those in the uppermost channel being largest, the height of the elevations gradually decreasing towards the lowermost channel where channels 16 and 17 are provided with no elevations.

A heat-exchanger package with laminations as shown in FIGS. 5 and 6 has the advantage that the channels create combined regulation of the turbulence. This increases the coefficient of heat transfer, designated $\alpha$, which constitutes a measurement of the heat transfer from a surface to the medium surrounding it and is dependent on the temperature and material of the surface and the temperature and movement of the medium. It is the movement of the medium (air) which is altered by all the throttling means in the surface of the channels. The coefficient of heat transfer is stated in $W/m^2K$.

The thermal effect transferred in the flat heat exchanger can be defined as $$P = k \times A \times \Delta v_m$$

where k = the overall coefficient of heat transfer, $W/m^2K$

A = the heat-transferring surface, $m^2$ $\Delta v_m$ = the logarithmic mean temperature difference, K $$k = \frac{1}{\frac{1}{\alpha_1} + \frac{d}{\lambda} + \frac{1}{\alpha_2}}$$

$\alpha_1$ = the coefficient of heat transfer on one side of the lamination (e.g. air leaving-aluminium foil), $w/m^2K$ $\alpha_2$ = the coefficient of heat transfer on the other side of the lamination (e.g. air entering-aluminium foil), $W/m^2K$ d = the thickness of the lamination, m λ = the heat conductivity of the lamination, $W/m^2K$ This in turn leads to an increase in the temperature efficiency which, for flat heat exchangers, can be defined as $$\eta = \frac{t_2 - t_1}{t_3 - t_1}$$

where $t_1$ = the temperature of the air entering the premises before the heat exchanger $t_2$ = the temperature of the air entering the premises after the heat exchanger $t_3$ = the temperature of the air leaving the premises before the heat exchanger.

The temperature efficiency is a measurement of the heat-transfer efficiency. The greater the increase, the higher the α-value obtained, and vice versa if the increase is less. Thanks to their raised portions the air-leaving laminations have varying α-value from channel to channel. In channels with lower α-value (including channels with no elevations), the air leaving the premises will emit less heat to the walls along the length of the channel. The air leaving will therefore retain a higher temperature at the outlet of the channel than air passing air-leaving channels with elevations, and thus with higher α-value. The air-entering laminations differ in that the part of the laminations with elevations lies below the air-leaving channels with higher α-value. The air-entering channels thus contribute to greater heat emission closest to their inlets, from the air leaving the premises.

A relatively high α-value is induced in the part of the laminations with maximum elevations, thus giving high temperature efficiency. It is thus possible to obtain a relatively high mean temperature efficiency for the heat exchanger as a whole.

The elevations in the various channels also cause extra pressure resistance which in turn leads to an uneven flow of air in the various channels. Air flowing in channels with no elevations will have a higher flow rate than in channels with elevations. The flow rate decreases with increasing elevations in the channels. The time spent by the warm air leaving the premises is thus shorter in the smooth channels than in the others and, due to the short-through flow times, it will therefore emit less heat to the walls of the surrounding channels. This means that, at the outlet of the heat exchanger, the temperature of the air leaving the premises is higher in smooth channels and decreases with increasing elevations in each channel.

A heat-exchanger package according to the present invention enables different degrees of heat transfer in different channels, which in turn gives different air temperatures at the outlet. When dimensioning the various channels the aim is for the temperature at the outlet in all air-leaving channels to be approximately the same. Dimensioning is performed in purely experimental manner.

In FIG. 2, the broken line c indicates the desired temperature distribution in the heat exchanger according to the present invention. This temperature distribution has been obtained experimentally. The unbroken lines a and b represent the temperature distribution in a conventional flat heat exchanger. It can thus be seen from the broken line that the temperature acquires a high value in the coldest corner of the heat exchanger which is the object of the invention. This temperature increase extends considerably 100% utilization of the flat heat exchanger according to the invention. A heat exchanger has thus been created which can be used in shifts at lower outside temperatures than conventional heat exchangers.

FIG. 2 shows that in a flat heat exchanger according to the present invention, the following values can be achieved for the quantities stated:

| | |
|---|---|
| $t_{fin}$ | = 22° C. |
| $t_{tin}$ | = −2° C. |
| $t_1$ | = 3° C. |
| $t_2$ | = 8° C. |
| $t_3$ | = 11.6° C. |
| $t_4$ | = 8.2° C. |
| $\Delta t_1$ | = 8.6° C. |
| $\Delta t_2$ | = 0.2° C. |

The following table shows the savings in energy possible with the aid of a heat exchanger according to the present invention.

| | | Total degree hours/year for post-heating the air entering to +20° C. | | |
|---|---|---|---|---|
| | Normal temperature | 8° C. | 5° C. | 0° C. |
| A | A conventional heat exchanger | 36,200 | 50,400 | 79,300 |
| B | The new heat exchanger | 34,500 | 45,100 | 66,600 |
| | Difference A-B | 1,700 | 5,300 | 12,700 |
| C | Heat exchanger without freezing | 34,200 | 44,200 | 60,800 |
| | Difference A-C | 2,000 | 6,200 | 18,500 |

The concept "degree hours", °Ch, is used to calculate the energy requirement for heating air.

Degree hours indicates the specific heat requirement, i.e. the sum of the difference between the temperature of the air entering, after the heat exchanger, and the desired temperature of the air entering the premises being heated, multiplied by the time during which the temperature difference prevails. The number of degree hours is calculated for the entire heating season and is therefore expressed in degree hours/year.

The table above presents the number of degree hours/year required to post-heat the air entering to +20° C. for flat heat exchangers with a temperature efficiency = 60% with defrosting and efficiency regulation. The values are calculated with the aid of duration diagrams and are applicable for air-leaving temperatures of +22° C. and relative humidity 25%.

The table shows that the number of degree hours for post-heating when using the new type of heat exchanger decreases sharply and is not far from the number of degree hours when using heat exchangers without freezing (e.g. rotating heat exchangers). The following offers an illustration of the savings obtained with the use of the heat exchanger according to the invention in comparison with a conventional flat heat exchanger.

EXAMPLE:

flow of air entering = 5 $m^3/S$ number of degree hours-from the table above cost 0.3 SEK/WKh Calculation of saving in energy.

The normal temperature is the mean temperature over a year in a certain town. In the example three different towns in Sweden were selected, with their normal temperatures (from VVS manual):

Malmö +8° C.

Gävle +5° C.
Pajala 0° C.

The energy requirement is defined as follows $Q = q \times p \times Cp \times \Delta t \times$ operating time ($\Delta t \times$ operating time = degree hours)

q = flow of air entering to be heated, $m^3/S$ r = density of air (at 20° C. = 1.2 $kg/m^3$)

Cp = specific thermal capacity of the air (at 20° C. = 1.007 kJ/kg K)

$\Delta t$ = temperature difference between temperature of air entering after the heat exchanger and the desired temperature of air entering the premises The number of degree hours saved when using the new heat exchanger (difference A–B) was taken from Table 1.

For a normal temperature of +8° C., $Q = 5 \times 1.2 \times 1 \times 1700 = 10200$ kWh Annual cost = energy requirement × energy cost i.e. 10200 kWh × 0.3 SEK/Kwh = 3060 SEK/year.

For a normal temperature of +5° C.

$Q = 5 \times 1.2 \times 1 \times 5300 = 31800$ kWh 31800 kWh × 0.3 SEK/Kwh = 9540 SEK/year.

For a normal temperature of +0° C.

$Q = 5 \times 1.2 \times 1 \times 12700 = 76200$ kWh 76200 kWh × 0.3 SEK/Kwh = 22860 SEK/year.

The saving in energy obtained by the use of heat exchangers according to the invention is considerable and increases as the normal temperature drops.

In comparison with a conventional heat exchanger, it is found that with a heat exchanger according to the invention, the equalization of the temperature distribution at the outlet of the air-leaving side, and the increased temperature in the "cold corner" greatly increases the period over which the flat heat exchanger can be utilized, which also constitutes a considerably saving in energy.

A flat heat exchanger according to the present invention thus requires two types of laminations.

To reduce cooling in the critical corner A close to the righthand outflow edge of the air leaving the heat exchanger and the righthand inflow edge for the air entering, it has been stated throughout above that the purpose of the present invention is to regulate the temperature at said critical corner to avoid freezing. This may also be expressed by stating that the temperature of the exhaust air leaving is distributed at its outflow so that cooling is reduced and the heat-absorbing capacity of the heat-absorbing medium increases from its inlet to its outlet. Said temperature distribution can also be effected by, before the inlet to the laminations for exhaust air leaving, causing the air entering to flow at different speeds. Inside the laminations the through-flow of the air leaving may deviate from laminar through-flow. The air leaving may even give rise to temperature distribution if the laminations for air leaving are modified to acquire an increased surface. This may be achieved by recesses or elevations.

It should be evident that the laminations for makeup air entering can be manipulated in the same way as that described for the laminations for exhaust air leaving.

Two or more of the measures mentioned above may be used for laminations both for exhaust air leaving and for makeup air entering.

I claim:

1. A recuperative heat exchanger for transferring heat from exhaust air to makeup air in an air handling system, said exchanger being in package form in which a number of rectangular laminations are stacked one on top of the other and together form a parallelepiped body in which each lamination consists of a flat part, preferably a plate, and a part to produce parallel flow channels, alternate laminations facing in the same direction and intermediate laminations facing in a direction 90° to the first direction, so that two channel systems crossing each other are formed, characterized in that the heat transfer rate through the exhaust air channels (16–21) while the makeup air is present in the makeup air channels (22–27) is such that, calculated from the inlet of the makeup air channels (22–27), the heat transfer rate for an exhaust air channel (16–21) increases with the distance from the inlet of the makeup air channels (22–27), and that each makeup air channel (22–27) has an increasing heat transfer rate along its extent from inlet to outlet.

2. A device as claimed in claim 1 characterized in that the heat transfer rate of each makeup air channel is dependent on the flow rate of the medium flowing through it.

3. A device as claimed in claim 1, characterized in that the transfer rate is dependent on the size of the contact surface in each channel, this being varied by means of elevations which have longitudinal extensions.

4. A device as claimed in claim 1, characterized in that the heat transfer rate is dependent on how much the flow of the through-flow medium deviates from laminar flow.

5. A recuperative heat exchanger for transferring heat from exhaust air to makeup air in an air handling system, said exchanger being in package form in which a number of rectangular laminations are stacked one on top of the other and together form a parallelepiped body in which each lamination consists of a flat part, preferably a plate, and a part to produce parallel flow channels, alternate laminations facing in the same direction and intermediate laminations facing in a direction 90° to the first direction, so that two channel systems crossing each other are formed, characterized in that the heat transfer rate through the exhaust air channels (16–21) while the makeup air is present in the makeup air channels (22–27) is such that, calculated from the inlet of the makeup air channels (22–27), the heat transfer rate for an exhaust air channel (16–21) increases with the distance from the inlet of the makeup air channels (22–27), and the heat transfer rate is dependent on the size of the contact surface in each channel, this being varied by means of elevations which have longitudinal extensions.

6. A device as claimed in claim 5 characterized in that the number of elevations (9, 10, 11) in a channel determines the heat transfer rate.

7. A device as claimed in claim 6 in which the bottom of each channel comprises thin sheet metal having said elevations projecting upwardly therefrom.

8. A device as claimed in claim 5 wherein the elevations in each of said exhaust air channels are of the same height.

9. A device as claimed in claim 5 wherein the elevations in each of said makeup air channels increases in the direction from the inlet to the outlet.

10. A device as claimed in claim 5 wherein the elevations in each channel are of similar shape.

11. A device as claimed in claim 5 wherein the elevations in each channel comprise elevations of diverse shape.

12. In a parallelepiped crossflow recuperative heat exchanger wherein a first plurality of layers of air conducting channels are arranged in a substantially right angular interleaved relationship with a second plurality of layers of air conducting channels to lie in heat transfer relationship therewith, said first plurality of layers of air conducting channels comprising a first intake face and a first discharge face, said second plurality of layers of air conducting channels comprising a second intake face and a second discharge face, the temperature of the air conducted through said first plurality of layers of air conducting channels being higher than the temperature of the air conducted through said second plurality of layers of air conducting channels, said heat transfer relationship resulting in an air temperature gradient across said first discharge face increasing in the direction from said second intake face towards said second discharge face, said temperature gradient at its lower end near the intersection of said second intake face and said first discharge face causing a loss of exchanger efficiency by generating a frost buildup in said first plurality of air conducting channels in the neighborhood of said intersection when the temperature of the air in said second conducting channels falls below the freezing point of moisture, the improvement comprising; means in at least one of said first plurality of layers of conducting channels for increasing the rate of heat transfer from said first air conducting channels to said second air conducting channels in a direction from said second intake face to said second discharge face whereby said temperature gradient across said first discharge face is narrowed thereby reducing the frost generating problem.

13. The combination of claim 12 wherein said means for increasing the rate of heat transfer comprises raised portions projecting into the air stream of selected air conducting channels of said first plurality of layers.

14. The combination of claim 13 wherein the heat transfer rate of said first air conducting channels is determined by the presence or absence of raised portions in the channels and the extent of the raised portion projection therein.

15. The combination of claim 14 wherein each said first plurality of layers of air conducting channels comprises a plurality of smooth bore conducting channels of a lesser heat transfer rate adjacent to said second intake face sequentially followed by heat conducting channels with projections of increasing extent in each channel in the direction of said second discharge face, the projections in each individual channel being of the same height.

16. The combination of claim 12 wherein said means for increasing the rate of heat transfer comprises raised portions projecting into the air stream of said air conducting channels of said second plurality of layers.

17. The combination of claim 16 wherein each of said air conducting channels of said second plurality of layers is provided with a smooth bore portion adjacent the second intake face followed by a series of projections of increasing height extending in the direction of said second discharge face.

18. The combination of claim 12 wherein the heat transfer rate of said first and second plurality of layers of heat conducting channels is at a minimum in the area adjacent said second intake face.

19. A heat exchanger comprising a number of rectangular laminations stacked one on top of the other and together forming a parallelepiped body in which each lamination comprises a flat sheet with spaced flanges forming a layer of flow channels, alternate laminations facing in the same direction and interminate laminations facing in a direction 90 degrees to the first direction, the lamination layers so stacked forming a crossflow, two path system wherein a heat emitting medium flowing in a first plurality of channels from a first inlet face to a first outlet face is placed in heat transfer relationship with a heat absorbing medium flowing in a second plurality of channels from a second inlet face to a second outlet face, means in said first plurality of channels for increasing the rate of heat transfer across a layer of first channels in the direction from said second inlet face to said second outlet face, and means in said second plurality of channels for increasing the rate of heat transfer along said second channels in the direction from said second inlet face to said second outlet face.

* * * * *